US007566256B2

(12) United States Patent
Wai

(10) Patent No.: US 7,566,256 B2
(45) Date of Patent: Jul. 28, 2009

(54) FRICTIONAL JOINT FOR TOYS

(75) Inventor: Fuk Chai Alvin Wai, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 450 days.

(21) Appl. No.: 11/393,365

(22) Filed: Mar. 29, 2006

(65) Prior Publication Data

US 2006/0228985 A1 Oct. 12, 2006

Related U.S. Application Data

(63) Continuation of application No. 10/712,498, filed on Nov. 12, 2003, now Pat. No. 7,021,989.

(60) Provisional application No. 60/426,021, filed on Nov. 12, 2002.

(51) Int. Cl.
*A63H 3/36* (2006.01)

(52) U.S. Cl. ..... 446/381; 446/376

(58) Field of Classification Search ..... 446/381, 446/383, 384, 378, 376
See application file for complete search history.

(56) References Cited

U.S. PATENT DOCUMENTS

| | | | | |
|---|---|---|---|---|
| 546,791 | A | | 9/1895 | Verpillier et al. |
| 553,643 | A | | 1/1896 | Fausel |
| 634,503 | A | | 10/1899 | Morrow |
| 703,899 | A | | 7/1902 | Debes |
| 982,096 | A | | 1/1911 | Schoenhut |
| 1,270,781 | A | | 7/1918 | Cabana |
| 1,359,030 | A | * | 11/1920 | Cabana ..... 446/381 |
| 1,932,216 | A | | 2/1933 | Kallus |
| 2,129,421 | A | | 9/1938 | Hales |
| 2,215,500 | A | | 9/1940 | Greneker |
| 2,727,334 | A | | 12/1955 | Ostrander |
| 2,934,858 | A | * | 5/1960 | Weih ..... 446/379 |
| 3,010,253 | A | | 11/1961 | Ostrander |
| 3,094,376 | A | | 6/1963 | Thomas |
| 3,265,257 | A | | 8/1966 | Buonamici |
| 3,277,602 | A | | 10/1966 | Speers et al. |
| 3,557,471 | A | | 1/1971 | Payne et al. |
| 3,591,669 | A | | 7/1971 | Memory |
| 3,628,282 | A | | 12/1971 | Johnson |

(Continued)

FOREIGN PATENT DOCUMENTS

| | | |
|---|---|---|
| EP | 0250063 | 3/1987 |

(Continued)

OTHER PUBLICATIONS

1997 Playmates Prozone Figure.

(Continued)

*Primary Examiner*—Gene Kim
*Assistant Examiner*—Urszula M Cegielnik
(74) *Attorney, Agent, or Firm*—Kolisch Hartwell, PC

(57) ABSTRACT

Joints for movable toys, such as action figures, that use friction to maintain a fixed position. The toys include several body part members interconnected by a joint that includes a plug portion and a socket portion that receives the plug portion. The socket portion includes one or more protrusions, against which the plug portion is urged to create friction between the plug portion and the socket portion.

20 Claims, 3 Drawing Sheets

U.S. PATENT DOCUMENTS 3,648,405 A 3/1972 Tepper
3,699,710 A 10/1972 Glass et al.
3,701,215 A 10/1972 Marason et al.
3,731,426 A 5/1973 Lewis et al.
3,740,894 A 6/1973 Howland et al.
3,895,451 A 7/1975 Smrcka
3,942,284 A 3/1976 Kublan
3,955,311 A 5/1976 Lyons et al.
3,968,981 A * 7/1976 Suarez ..... 280/511
3,988,855 A 11/1976 Crabtree et al.
4,006,555 A 2/1977 England et al.
4,030,240 A 6/1977 Port
4,067,138 A 1/1978 Cederholm et al.
4,135,327 A 1/1979 Sapkus et al.
4,268,991 A 5/1981 Cotey et al.
4,274,224 A 6/1981 Pugh et al.
4,439,909 A 4/1984 Borgen et al.
4,467,555 A 8/1984 Terzian et al.
4,526,553 A 7/1985 Guerrero
4,552,480 A 11/1985 McIntyre
4,571,209 A 2/1986 Manning et al.
4,578,045 A 3/1986 Mayer et al.
4,623,318 A 11/1986 Tsiknopoulos et al.
4,649,010 A 3/1987 Bennett et al.
4,662,224 A 5/1987 Turbe
4,662,857 A 5/1987 Quinn et al.
4,669,998 A 6/1987 Amici et al.
4,673,374 A 6/1987 Kelley
4,674,990 A 6/1987 Ohno
4,680,018 A 7/1987 Ohno
4,680,019 A 7/1987 Baerenwald et al.
4,790,789 A 12/1988 Mathis
4,890,356 A 1/1990 Czech et al.
4,916,788 A 4/1990 Mitoya
4,952,189 A 8/1990 Barlow
4,968,280 A 11/1990 Kelley
4,995,846 A 2/1991 Mariol
5,257,873 A 11/1993 Abbat
5,676,484 A 10/1997 Chamberlin et al.
5,755,526 A 5/1998 Stanevich
5,897,417 A 4/1999 Grey
5,989,658 A 11/1999 Miura
6,033,284 A 3/2000 Rodriguez
6,042,451 A 3/2000 Feldman
6,110,002 A 8/2000 Langton
6,287,166 B1 9/2001 Lee et al.
6,328,625 B1 12/2001 Lee et al.
6,435,938 B1 8/2002 Lee et al.
6,482,068 B2 11/2002 Lee et al.
2002/0055322 A1 5/2002 Lee et al.
2002/0058458 A1 5/2002 Lee et al.
2002/0090880 A1 7/2002 Lee et al.
2002/0127949 A1 9/2002 Lee et al.

FOREIGN PATENT DOCUMENTS

EP 0256818 8/1987
JP 62-50112 3/1987
JP 62-128719 6/1987
JP 62-129076 6/1987
JP 62-246392 10/1987

OTHER PUBLICATIONS

1978 CPG Action Man Figure.
1996 Hasbro GI Joe Classic Collection Figure.
1994 Hasbro GI Joe Commemorative Edition Figure.
1987 Mattel Skipper Figure.
Supplementary European Search Report from European Patent Application No. EP 03 78 9759, mailed on Feb. 26, 2009.

* cited by examiner

FRICTIONAL JOINT FOR TOYS

CROSS-REFERENCE TO RELATED APPLICATIONS

This is a continuation application of U.S. patent application Ser. No. 10/712,498, filed on Nov. 12, 2003, now U.S. Pat. No. 7,021,989 which in turn claims priority under 35 U.S.C. 119(e) to U.S. Provisional Patent Application No. 60/426,021 entitled "Frictional Ball-And-Socket Waist Joint," filed Nov. 12, 2002. Both applications are incorporated herein by reference in their entirety for all purposes.

BACKGROUND

The present disclosure relates generally to movable toys, and more specifically, to joints of action figures and dolls. Movable action figures and dolls (e.g., action figures having shoulder/elbow joints, hip/knee joints, waist joints, etc.) can provide imaginative fun for children. Movable joint motion allows a child to configure a toy as he or she chooses. Examples of such toys are disclosed in U.S. Pat. Nos. 3,277,602; 3,628,282; 3,988,855; 4,274,224; 4,968,282; 5,989,658; and 6,435,938, the disclosures of which are incorporated herein by reference. Typically, it is desirable that the joints and other structures which enable relative movement be durable, enable the desired range of movement, and be relatively inexpensive to manufacture.

SUMMARY

The present disclosure is directed to a movable toy, such as a doll or action figure, having a joint or like mechanism that enables relative movement. In some embodiments, the toy includes two or more body part members interconnected by a joint having a plug and a socket for receiving the plug. The socket includes one or more protrusions, against which the plug is urged to create friction between the plug and socket, thereby restricting joint motion.

DETAILED DESCRIPTION

Figure 1:
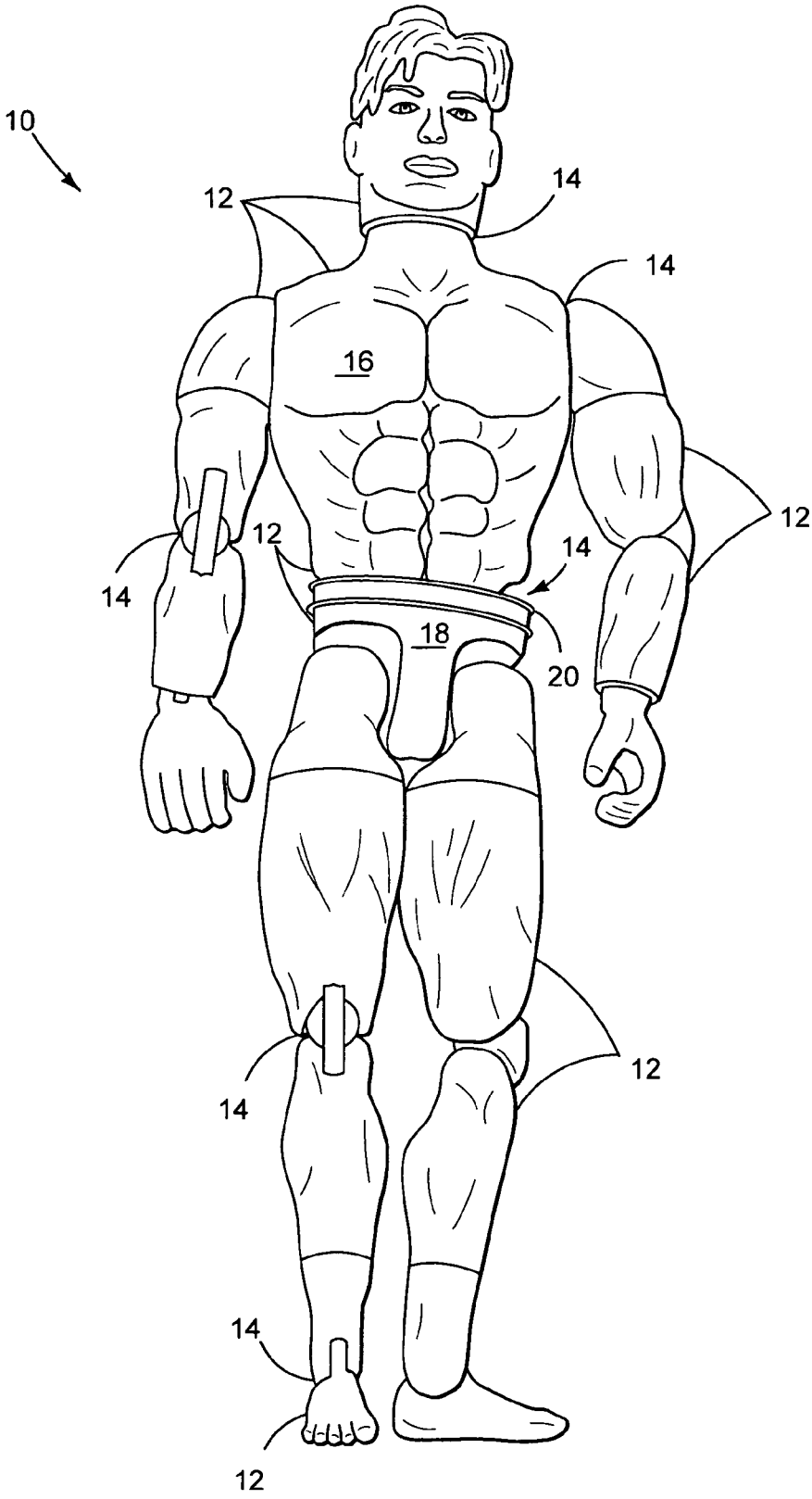
FIG. 1 depicts an embodiment of a movable toy according to the present description.

FIG. 1 depicts a toy 10 according to the present description. In the depicted example, toy 10 is implemented as an action figure having several body part members 12 with movable interconnections between the members. These movable interconnections take the form of joints 14 defined between body part members 12. The joints enable the various body part members to be moved relative to one another in various ways.

Typically, a given joint is configured to enable one part of the toy (e.g., a body part member) to be moved relative to another, and then maintain the relative position of the parts once a desired position has been achieved. For example, toy 10 has a first body part member, such as torso 16, and a second body part member, such as pelvis 18. One of joints 14 forms a waist joint 20, defined between torso 16 and pelvis 18 to enable relative motion between the torso and pelvis. The remaining description will focus primarily on the waist joint, though it should be appreciated that the structures and mechanisms to be discussed may be implemented in other locations on a doll, and in movable toys other than dolls.

As shown in FIGS. 2-5, joint 20 may include a plug portion or assembly 22, and a socket portion or assembly 24 that receives plug 22. Plug portion 22 is formed on one of the first and second body part members, such as on pelvis 18, while socket portion 24 is formed on the other of the first and second body part members, such as on torso 16. Socket portion 24 includes a friction assembly 26 that inhibits relative movement between plug portion 22 and socket portion 24. Friction is produced between multiple socket contact regions 28 and plug contact regions 30, also referred to as the operative surface of plug portion 22. In the depicted examples, contact regions take the shape of a sphere, though it should be appreciated that other shapes and configurations may be employed.

In some embodiments, socket portion 24 has a support surface or wall portion 32 with several protrusions 34 extending therefrom that form socket contact regions 28. Joint 14 may be adapted so that plug portion 22 is urged into contact with protrusions 34 so as to create friction therebetween. The body part members are therefore able to maintain their relative positions during play.

Figure 2:
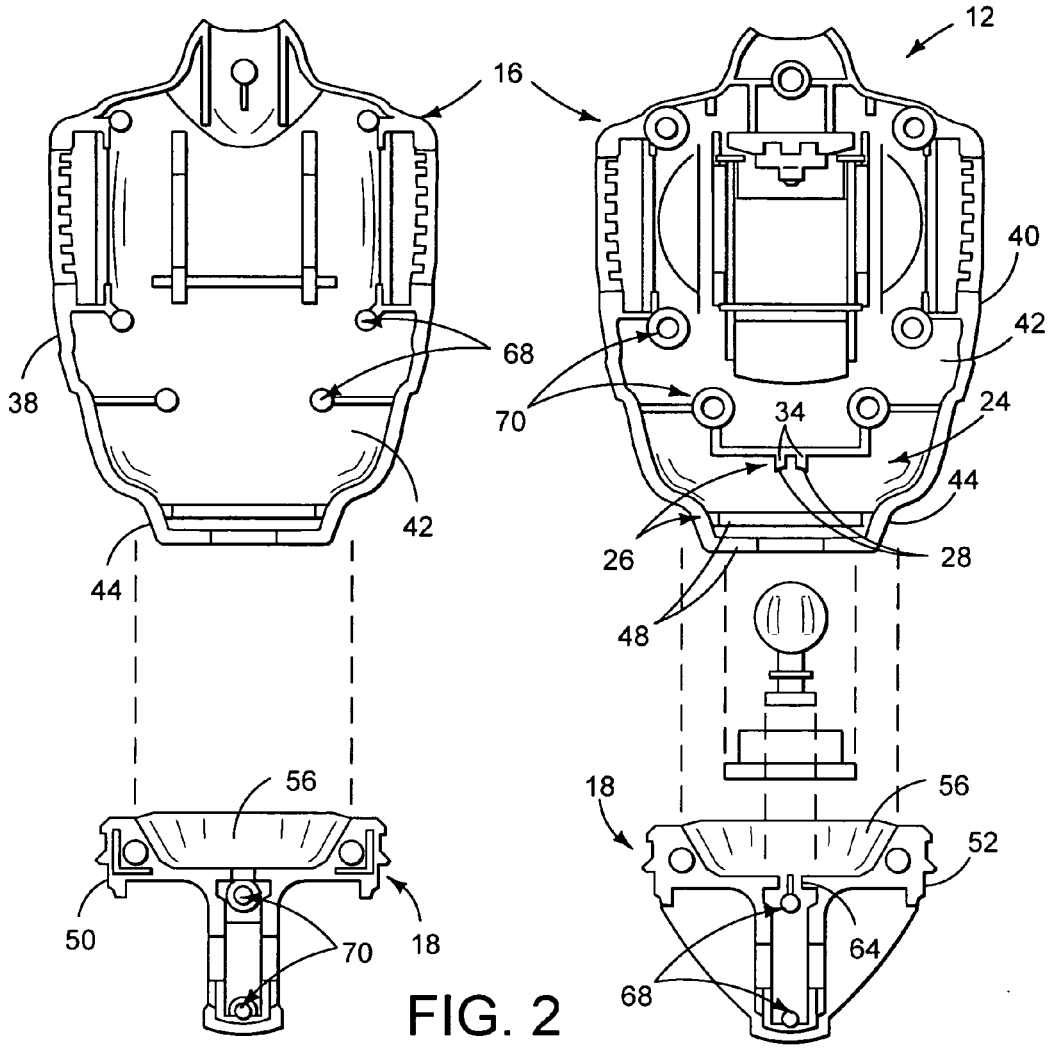
FIG. 2 is a cross-sectional exploded view of the movable toy of FIG. 1, showing components of the toy that are movably interconnected by a joint according to the present description.
Figure 3:
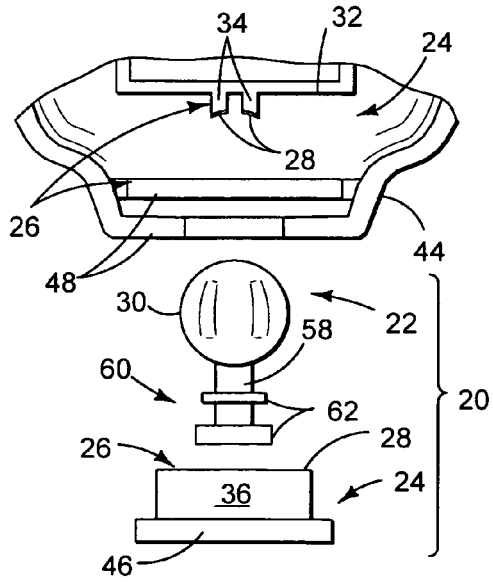
FIG. 3 is a detailed exploded view of the joint shown in FIG. 2.
Figure 4:
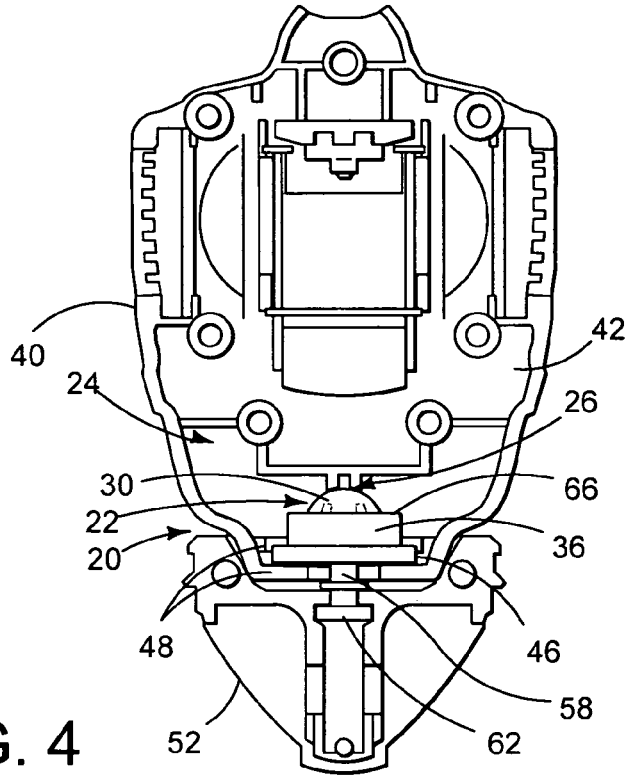
FIG. 4 is a cross-sectional view of the components of FIG. 2 assembled.

As previously mentioned, joint 14 is comprised of socket portion 24 and plug portion 22. These portions engage with one another to control relative movement between torso 16 and pelvis 18 (e.g., by inhibiting relative movement through friction), or other appropriate body part members 12. Plug contact region 30 articulates within socket portion 24. In some embodiments, plug contact region 30 is spherical and mates with a cylindrically shaped socket portion, as shown in FIGS. 2-4. Alternatively, only part of plug portion 22 may be convex and used as a contact region.

Figure 5:
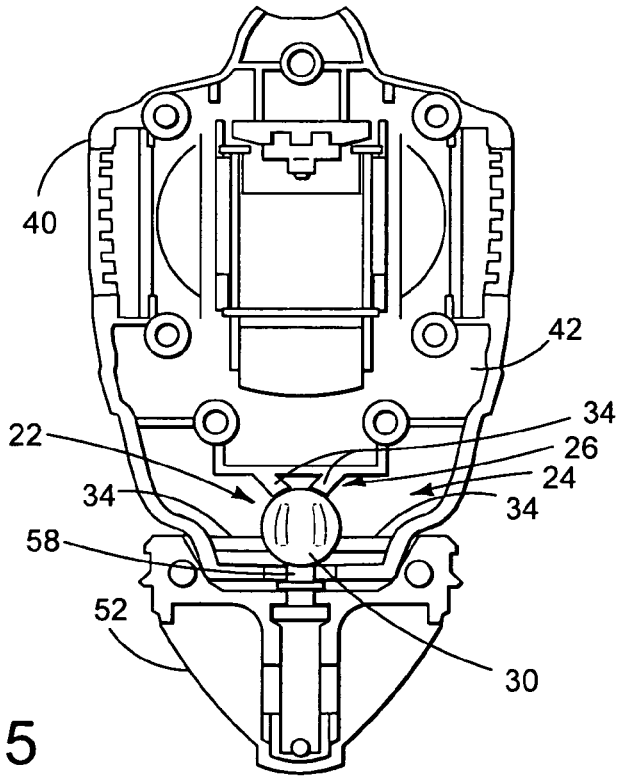
FIG. 5 is a cross-sectional view similar to FIG. 4, but showing an alternate embodiment of a joint according to the present description.

In some embodiments, such as shown in FIGS. 2-4, socket portion 24 includes a socket insert 36. This insert may be useful in retaining plug portion 22 captured and held within socket portion 24 and increasing the frictional surface contact between socket portion 24 and plug portion 22. In other embodiments, as shown in FIG. 5, socket insert 36 is replaced by additional protrusions 34, or extension of the existing lateral protrusions, thus reducing the number of overall components needed to assemble toy 10.

In the depicted examples, insert 36 has an opening sized to accommodate passage of a shaft 58 that extends away from operative surface 30 of plug portion 22. Typically, the opening is smaller than the diameter of operative surface 30, so as to maintain the operative surface captured and held within socket portion 24. Also, the area around the opening typically is adapted to contact the operative surface of plug portion 24 and urge it toward the frictional contact surfaces of the socket.

Socket portion 24 typically includes one or more protrusions 34 extending inward toward the operative surface of plug portion 22. The protrusions may be formed on the torso of the doll, as indicated in the figure, or may be manufactured as a separate piece to be inserted during assembly. Protrusions 34 typically are adapted to provide the friction described above, so as to inhibit movement (e.g., rotation) of plug portion 22 within socket portion 24, thereby inhibiting relative movement of the respective members of the toy (e.g., body part members 12). As shown in FIGS. 2-5, protrusions 34 may take the form of ribs having contact regions 28 configured to correspond to plug contact region 30. The protrusions shown in FIGS. 2-4 have ends that are angled opposite one another to form a V-shaped seat that straddles and receives the operative surface of plug portion 22. Alternatively, or additionally, socket contact regions 28 may be concave to provide increased contact with at least a portion of the convex contact region of plug portion 22, as shown in FIG. 5.

The protrusions themselves may also be aligned towards one another so that the protrusions approach operative surface 30 from different directions, or they may extend parallel to one another from the socket wall. Furthermore, the ends of the protrusions may be angled or formed with a concave contour to complement the concave operative surface of plug portion 22. In addition, the operative surface of the plug portion may be provided with grooves for receiving the protrusions, so as to provide desired constraints on the relative movement permitted between the parts of the toy.

As shown in FIG. 2, torso 16 may be subdivided into a torso front 38 and a torso back 40 that define an internal compartment 42. Internal compartment 42 may provide space for the joint components, so as to conceal the joint components and/or protect the components. Accordingly, in the depicted example, torso 16 is configured to conceal at least plug portion 22 and protrusions 34. The section of torso 16 nearest pelvis 18 forms a tapered base, or pelvis mating region 44, which allows a lower end of torso 16 to be recessed within pelvis 18, as shown in FIGS. 4 and 5.

Socket portion 24 may have additional structure to secure socket insert 36 within its respective body part member 12. As shown in FIGS. 3 and 4, socket insert 36 has a flange 46 that anchors socket insert 36 to torso 16 within internal torso compartment 42. As indicated, flange 46 may rest between plates 48 located in pelvis mating region 44 of torso 16 and may thereby be restricted from translating out of alignment once torso front 38 and torso back 40 are joined together.

Similar to torso 16, pelvis 18 may be formed from a pelvis front 50 and a pelvis back 52 that form an internal pelvis compartment 54, as shown in FIG. 2. Pelvis 18 further includes a cupped surface 56, which receives pelvis mating region 44 of torso 16, thereby concealing portions of joint 20.

Plug portion 22 may be anchored to the body part member opposite that in which socket portion 24 is mounted, such as to pelvis 18. As shown in FIG. 3, plug portion 22 may have a shaft 58 extending from operative surface 30 of the plug portion. At the end of shaft 58, opposite operative surface 30, an anchor 60 may be provided to secure the plug portion to pelvis 18, via plug flange 62. Referring to FIG. 4, flange 62 secures plug portion 22 to pelvis 18 by engagement with a pelvis plate 64 located within pelvis 18. As shown, shaft 58 has two flanges 62 that straddle a single pelvis plate 64. Alternatively, pelvis 18 may have a pair of plates, between which a single flange on shaft 58 rests.

In FIG. 4, at least some of plug portion 22 may extend through an aperture 66 of socket portion 24, such as via shaft 58. Torso plates 48 and pelvis plates 64 typically have notches or other openings to provide a channel through the plates, for passage of shaft 58. This arrangement allows plug portion 22 to be mounted by one end in pelvis 18 and the other end to be received by torso 16 for engagement with socket portion 24, as depicted in FIG. 4.

Once the components of toy 10 have been aligned in their appropriate positions, as previously discussed, the front and back portions of torso 16 and pelvis 18 are joined together using any suitable method, such as those generally known in the art. In some embodiments one half of a body part member includes pins or posts 68, while the other half of the body part member includes receptacles 70 that receive posts 68. In such a configuration, posts 68 are simply aligned with, and pressed into, receptacles 70 to snap the two halves together.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

I claim:

1. A movable toy comprising:

a torso member having a pelvis mating region; and a pelvis member having a cupped surface adapted to receive the pelvis mating region, wherein a joint is defined between the torso and pelvis members to enable rotation between the torso and pelvis members, wherein the joint includes:

a plug portion coupled to the pelvis member and having an operative surface; and a socket portion coupled to the torso member and having a removable insert adapted to receive the plug portion, the socket portion further having multiple spaced apart protrusions adapted to contact the operative surface of the plug portion so as to create friction therebetween.

2. The movable toy of claim 1, wherein the protrusions are formed as ribs that extend toward the operative surface of the plug portion from a wall of the socket portion.

3. The movable toy of claim 2, wherein the ribs extend from the wall of the socket portion parallel to one another.

4. The movable toy of claim 1, wherein the protrusions form a seat adapted to receive and center the operative surface of the plug portion thereupon.

5. The movable toy of claim 4, wherein the operative surface of the plug portion is convex and the protrusions each have a corresponding concave contact region.

6. The movable toy of claim 1, wherein the socket portion is integrally formed with the torso member.

7. The movable toy of claim 1, wherein the plug portion includes a shaft that extends through an opening in the insert and places the operative surface in contact with the multiple spaced apart protrusions.

8. The movable toy of claim 7, wherein the insert is positioned so that the insert at least partially contacts the operative surface of the plug portion and urges the operative surface into engagement with the protrusions.

9. The movable toy of claim 1, wherein the torso and pelvis members are adapted to conceal the plug portion and the protrusions.

10. A waist joint for a toy comprising:

a pelvis member having a plug portion with a shaft and an operative surface; and a torso member having a socket portion adapted to receive the plug portion, the socket portion including a friction assembly having multiple distinct contact regions that engage the operative surface of the plug portion and, the socket portion also including a removable insert positioned at least partially within the socket, portion and adapted to maintain the plug portion in frictional engagement with the socket portion.

11. The waist joint of claim 10, wherein the removable insert includes a substantially cylindrical portion.

12. The waist joint of claim 11, wherein the removable insert includes a flange extending outwardly from the cylindrical portion, thereby forming a collar to retain the removable insert within the socket portion.

13. The waist joint of claim 12, wherein the socket portion includes plates that straddle the flange.

14. The waist joint of claim 10, wherein the removable insert has an opening sized to accommodate passage of the shaft of the plug portion.

15. The waist joint of claim 14, wherein the opening is smaller than the operative surface.

16. The waist joint of claim 10, wherein the removable insert is adapted to contact the operative surface of the plug portion and urge the operative surface towards the contact regions of the friction assembly.

17. The waist joint of claim 10, wherein the torso member has a pelvis mating region and the pelvis member has a cupped surface adapted to receive the pelvis mating region.

18. The waist joint of claim 10, wherein the torso member includes a torso front and a torso back that define an internal compartment configured to conceal the socket portion.

19. The waist joint of claim 10, wherein each of the multiple contact regions is formed on an end of a protrusion that extends toward the operative surface of the plug portion.

20. A joint for controlling relative movement between two interconnected body part members of a moveable toy, the joint comprising:

first and second portions on first and second body part members, respectively, the first portion including a spherical operative surface, and the second portion including a cylindrical protrusion having a diameter smaller than that of the operative surface of the first portion, the cylindrical protrusion further including a convex contact region configured to mate with the operative surface of the first portion, such that the operative surface is partially seated in and urged against the contact region, wherein the friction produced thereby inhibits relative movement of the interconnected body part members from a desired position.

* * * * *